US007775281B2

(12) United States Patent
Kosakewich

(10) Patent No.: US 7,775,281 B2
(45) Date of Patent: Aug. 17, 2010

(54) METHOD AND APPARATUS FOR STIMULATING PRODUCTION FROM OIL AND GAS WELLS BY FREEZE-THAW CYCLING

(76) Inventor: Darrell S. Kosakewich, 115, 9650 - 20 Avenue, Edmonton, AB (CA) T6N 1G1

( * ) Notice: Subject to any disclaimer, the term of this patent is extended or adjusted under 35 U.S.C. 154(b) by 322 days.

(21) Appl. No.: 11/746,470

(22) Filed: May 9, 2007

(65) Prior Publication Data

US 2008/0035345 A1 Feb. 14, 2008

Related U.S. Application Data

(60) Provisional application No. 60/746,937, filed on May 10, 2006.

(51) Int. Cl.
*E21B 36/00* (2006.01)

(52) U.S. Cl. ..... 166/302; 166/308.1

(58) Field of Classification Search ..... 166/302, 166/57, 248, 249, 177.5, 308.1, 243
See application file for complete search history.

(56) References Cited

U.S. PATENT DOCUMENTS 3,301,326 A * 1/1967 McNamer ..... 166/281
3,500,930 A * 3/1970 Bradley ..... 166/295
3,602,310 A * 8/1971 Halbert ..... 166/303
3,882,937 A * 5/1975 Robinson ..... 166/267
4,030,547 A * 6/1977 Ross ..... 166/212
4,124,253 A * 11/1978 Latiolais et al. ..... 299/6
4,424,858 A * 1/1984 Elliott et al. ..... 166/52
4,474,238 A * 10/1984 Gentry et al. ..... 166/268
5,097,903 A * 3/1992 Wilensky ..... 166/266
5,653,287 A * 8/1997 Wilson et al. ..... 166/302
5,661,233 A * 8/1997 Spates et al. ..... 73/61.45
6,209,633 B1 * 4/2001 Haynes ..... 166/72
2005/0121396 A1 * 6/2005 Kosakewich ..... 210/748
2007/0095537 A1 * 5/2007 Vinegar ..... 166/302
2009/0101348 A1 * 4/2009 Kaminsky ..... 166/302

* cited by examiner

*Primary Examiner*—Jennifer H Gay
*Assistant Examiner*—Kipp C Wallace
(74) *Attorney, Agent, or Firm*—Donald V. Tomkins

(57) ABSTRACT

In a well stimulation method, a subsurface formation is fractured by freezing a water-containing zone within the formation in the vicinity of a well, thereby generating expansive pressures which expand or created cracks and fissures in the formation. The frozen zone is then allowed to thaw. This freeze-thaw process causes rock particles in existing cracks and fissures to become dislodged and reoriented therewithin, and also causes new or additional rock particles to become disposed within both existing and newly-formed cracks and fissures. The particles present in the cracks and fissures act as natural proppants to help keep the cracks and fissures open, thereby facilitating the flow of fluids from the formation into the well after the formation has thawed. Preferably, the freeze-thaw steps are carried out on a cyclic basis. Optionally, propagation of the freezing front into the formation may be enhanced by the introduction of low-frequency wave energy into the formation.

16 Claims, 5 Drawing Sheets

METHOD AND APPARATUS FOR STIMULATING PRODUCTION FROM OIL AND GAS WELLS BY FREEZE-THAW CYCLING

CROSS-REFERENCE TO RELATED APPLICATIONS

This application claims the benefit, pursuant to 35 U.S.C. 119(e), of U.S. Provisional Application No. 60/746,937, filed on May 10, 2006, and said provisional application is incorporated herein by reference in its entirety.

FIELD OF THE INVENTION

The present invention relates in general to methods for enhancing the efficiency of recovery of liquid and gaseous hydrocarbons from oil and gas wells. In particular, the invention relates to methods for fracturing a subsurface formation to facilitate or improve the flow of hydrocarbon fluids from the formation into a well.

BACKGROUND OF THE INVENTION

A well drilled into a hydrocarbon-bearing subsurface formation, during an initial post-completion stage, commonly produces crude oil and/or natural gas without artificial stimulation, because pre-existing formation pressure is effective to force the crude oil and/or natural gas out of the formation into the well bore, and up the production tubing of the well. However, the formation pressure will gradually dissipate as more hydrocarbons are produced, and will eventually become too low to force further hydrocarbons up the well. At this stage, the well must be stimulated by artificial means to induce additional production, or else the well must be capped off and abandoned. This is a particular problem in gas wells drilled into "tight" formations—i.e., where natural gas is present in subsurface materials having inherently low porosities, such as sandstone, limestone, shale, and coal seams (e.g., coal bed methane wells).

Despite the fact that very large quantities of hydrocarbons may still be present in the formation, it has in the past been common practice to abandon wells that will no longer produce hydrocarbons under natural pressure, where the value of stimulated production would not justify the cost of stimulation. In other cases, where stimulation was at least initially a viable option, wells have been stimulated for a period of time and later abandoned when continued stimulation became uneconomical, even though considerable hydrocarbon reserves remained in the formation. With recent dramatic increases in market prices for crude oil and natural gas, well stimulation has become viable in many situations where it would previously have been economically unsustainable.

There are numerous known techniques and processes for stimulating production in low-production wells or in "dead" wells that have ceased flowing naturally. One widely-used method is hydraulic fracturing (or "fraccing"). In this method, a fracturing fluid (or "frac fluid") is injected under pressure into the subsurface formation. Frac fluids are specially-engineered fluids containing substantial quantities of proppants, which are very small, very hard, and preferably spherical particles. The proppants may be naturally formed (e.g., graded sand particles) or manufactured (e.g., ceramic materials; sintered bauxite). The frac fluid may be in a liquid form (often with a hydrocarbon base, such as diesel fuel), but may also be in gel form to enhance the fluid's ability to hold proppants in a uniformly-dispersed suspension. Frac fluids commonly contain a variety of chemical additives to achieve desired characteristics.

The frac fluid is forced under pressure into cracks and fissures in the hydrocarbon-bearing formation, and the resulting hydraulic pressure induced within the formation materials widens existing cracks and fissures and also creates new ones. When the frac fluid pressure is relieved, the liquid or gel phase of the frac fluid flows out of the formation, but the proppants remain in the widened or newly-formed cracks and fissures, forming a filler material of comparatively high permeability that is strong enough to withstand geologic pressures so as to prop the cracks and fissures open. Once the frac fluid has drained away, liquid and/or gaseous hydrocarbons can migrate through the spaces between the proppant particles and into the well bore, from which they may be recovered using known techniques.

Another known well stimulation method is acidizing (also known as "acid fracturing"). In this method, an acid or acid blend is pumped into a subsurface formation as a means for cleaning but extraneous or deleterious materials from the fissures in the formation, thus enhancing the formation's permeability. Hydrochloric acid is perhaps most commonly as the base acid, although other acids including acetic, formic, or hydrofluoric acid may be used depending on the circumstances.

Although fraccing and acidizing have proven beneficial capabilities, there remains a need for new and more effective methods for stimulating production in oil and gas wells. In particular, there is a need for stimulation methods that are more economical than known methods, and which can enable recovery of higher percentages of non-naturally-flowing hydrocarbons from low-permeability formations than has been possible using known stimulation methods. Even more particularly, there is a need for such methods that do not entail the injection of acids or other chemicals into subsurface formations, and that do not require the introduction of proppants into the formation. The present invention is direction to these needs.

BRIEF SUMMARY OF THE INVENTION

In general terms, the present invention is a well stimulation method whereby a subsurface formation is fractured by injecting an aqueous solution (e.g., fresh water) into the formation and then inducing freezing such that the aqueous solution expands, thereby generating expansive pressures which widen existing formation cracks and fissures in the formation and/or cause new ones to form. This process causes rock particles in existing cracks and fissures to be dislodged and reoriented therewithin, and also causes new or additional rock particles to become disposed within both existing and newly-formed cracks and fissures. Thawing is induced in the frozen formation, such that the aqueous solution drains from the formation. The particles present in the cracks and fissures act as natural proppants to help keep the cracks and fissures open in substantially the same configuration as created during the freezing step.

Accordingly, in a first aspect the present invention is a method for stimulating flow of petroleum fluids from a subsurface formation into a wellbore drilled into and exposed to the formation, said method comprising the steps of:

(a) providing a string of return tubing having an upper end and a lower end;

(b) providing a string of supply tubing having an upper end and a lower end, said lower end being open, and said supply tubing having expander means associated with said lower end;

(c) disposing the return tubing string within the wellbore so as to position the lower end of the return tubing at a selected depth, and so as to form a well annulus between the return tubing and the wellbore;

(d) disposing the supply tubing string within the return tubing string so as to position the expander means at a selected depth, and so as to form a tubing annulus between the supply tubing and the return tubing, with the return tubing string having associated plug means sealing off the tubing annulus at a selected location below the expander means;

(e) ensuring that an aqueous fluid is present in the well annulus to a selected level above the depth of the expander means;

(f) initiating a freezing cycle by introducing a flow of liquid refrigerant into the supply tubing, such that the refrigerant passes through the expander means and resultantly vaporizes and flows into the tubing annulus, and continuing the flow of refrigerant to freeze the aqueous fluid in a zone adjacent the expander means and to freeze an adjacent first region of the formation; and (g) initiating a thaw cycle by discontinuing the flow of refrigerant and allowing said first region of the formation to thaw.

Preferably, the freeze-thaw steps are carried out on a cyclic basis. Each additional freeze-thaw cycle will cause additional formation fracturing, plus the creation of additional natural proppant particles. The appropriate or most effective number of freeze-thaw cycles in a given application will depend on a variety of factors including the physical properties of the formation materials.

In preferred embodiments of the method of the present invention, means are provided for subjecting the subsurface formation to LF wave energy during the freezing cycle of the method. This will have the effect of reducing the time required for each freezing cycle, for a given extent of penetration of the freezing front into the formation, thereby reducing the total time required for the well stimulation operation, thus enabling the well to be returned to production sooner.

In a second aspect, the present invention is an apparatus for practicing the method of the invention.

BRIEF DESCRIPTION OF THE DRAWINGS

Embodiments of the invention will now be described with reference to the accompanying Figures, in which numerical references denote like parts, and in which.

DETAILED DESCRIPTION OF THE PREFERRED EMBODIMENT

Figure 1:
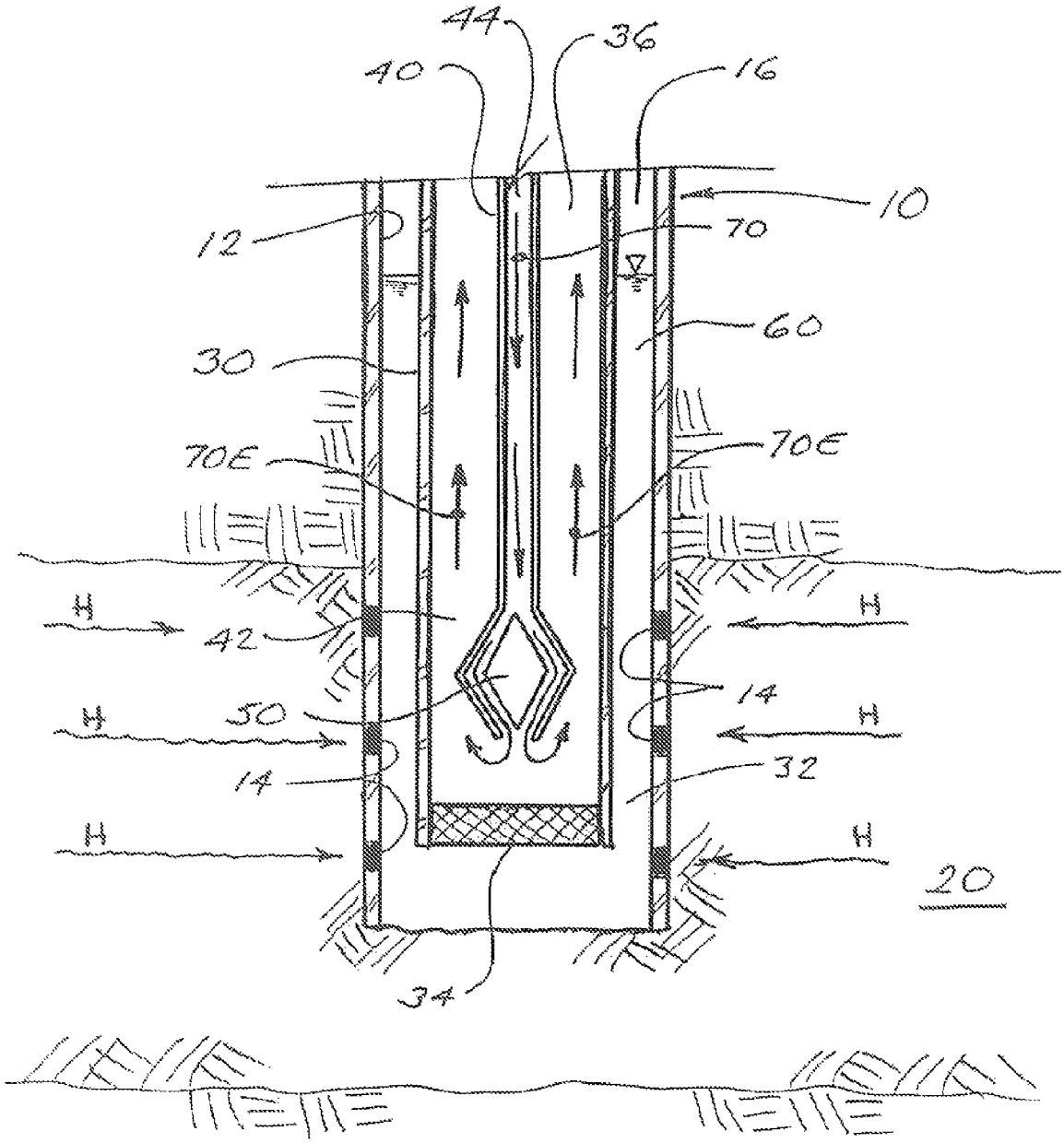
FIG. 1 is a cross-section through a vertical well extending into a subsurface formation, with refrigeration apparatus in accordance with one embodiment of the invention.

The method of the invention is schematically illustrated in FIG. 1, which shows a vertical well 10 drilled into a hydrocarbon-bearing subsurface formation 20. Well 10 will typically have a well liner 12, with perforations 14 in the production zone (i.e., the portion of well 10 that penetrates formation 20) to allow hydrocarbons H to flow from formation 20 into well 10. In some geologic formations it may be feasible to for well 10 to be unlined, such that hydrocarbons can flow directly into well 10. In either case, well 10 can be said to be exposed to formation 20, for purposes of this patent specification. When well 10 is producing, formation fluids comprising liquid and/or gaseous hydrocarbons are conveyed to the surface through a string of production tubing (not shown) which is disposed within well 10 down to the production zone.

To use the well stimulation method of the present invention, the production tubing (if still present) is withdrawn from well 10, and then a string of refrigerant return tubing 30 is inserted into well 10, creating a generally annular well annulus 16 surrounding return tubing 38. The lower end 32 of return tubing 30 is sealed off by suitable plug means 34; by way of non-limiting example, plug means 34 may be in the form of a conventional packer disposed within the bore of return tubing 30 in accordance with known methods, or in the form of a permanent welded end closure. A string of refrigerant supply tubing 40 extends within return tubing 30, creating a generally annular tubing annulus 36 surrounding return tubing 30. The lower end 42 of supply tubing 40 incorporates or is connected to a flow restrictor or other type of expander means (conceptually indicated by reference numeral 50) for creating a pressure drop so as to induce vaporization of a liquid refrigerant, in accordance with well-known refrigeration principles and technology.

In many cases where formation pressure has been depleted to the point that hydrocarbons will no longer flow naturally, water 60 will have accumulated within well 10, and will permeate formation 20. However, to use the present method in depleted wells that are not already water-laden, water 60 is introduced to a desired height within well annulus 16, from which it may flow into cracks and fissures in formation 20 (either directly or through perforations 14).

A suitable liquid refrigerant 70 (e.g., liquid nitrogen, liquid carbon dioxide, calcium chloride brine, or, preferably, liquid propane) is pumped downward through bore 44 of supply tubing 40. Liquid refrigerant 70 is forced past expander means 50, causing the liquid refrigerant 70 to expand. Expander means 50 may take any of various forms in accordance with known refrigeration technology. In the embodiment illustrated in FIG. 1, expander means 50 is a streamlined flow obstruction that will cause an increase in flow velocity of liquid refrigerant 70, thus causing a pressure drop in accordance with known principles of fluid dynamics, resulting in expansion and evaporation (i.e., phase change) of liquid refrigerant 70.

Because the lower end 32 of return tubing 30 is plugged, the expanded refrigerant 70E is forced upward through tubing annulus 36 to the surface, where it passes through a condenser (not shown) for recirculation into supply tubing 40. In accordance with well-known refrigeration principles, the circulation of refrigerant 70 through supply tubing 40 and return tubing 30, as described above, results in the absorption and removal of heat from water 60 by refrigerant 70, to the point that water 60 freezes. A freezing front propagates radially outward from well 10 into formation 20 as refrigerant 70 continues to circulate and remove more heat, with the result that water within cracks and fissures in formation 20 freezes and expands, causing fracturing of formation 20 as previously described.

It has been found that the propagation of a freezing front through a geological formation can be enhanced or expedited by introducing low-frequency wave energy into the formation. In this context, low-frequency (or LF) waves should be understood as being waves in the approximate range of 15 to 300 cycles per second; i.e., 15-300 Hertz (Hz). The LF waves may be generated either electromagnetically or mechanically. Accordingly, in preferred embodiments of the invention, means for generating LF waves will be provided in association with lower end 32 of return tubing 30 or lower end 42 of supply tubing 40.

In a particularly preferred embodiment, the LF wave-generating means will be incorporated into expander means 50. Where expander means 50 is in the form of a flow obstruction, it may be adapted to generate LF waves mechanically, as shock waves caused by the movement of liquid refrigerant 70 past the flow restriction. In alternative embodiments, an electromagnetic wave transmitter is provided in association with lower end 32 of return tubing 30 or lower end 42 of supply tubing 40. In such embodiments, the amplitude and frequency of LF waves can be regulated by control means (not shown) located at the surface. Preferably, the LF waves are generated in pulsed fashion, which is believed to enhance the effectiveness of the wave energy in advancing the freezing front within formation 20.

Persons of ordinary skill in the art of the invention will appreciate that mechanical or electromagnetic means for generating LP waves can be provided in a variety of forms using known technology; accordingly, embodiments of the invention involving the use of LF waves are not to be limited to the use of any specific type of LF wave generation means.

After being frozen as described above, preferably in conjunction with exposure to LF waves, the affected region of formation 20 is allowed to warm up so that water that has frozen therewithin will melt and drain into well 10. Most preferably, formation 20 will be exposed to multiple freeze-thaw cycles, enhanced with the introduction of LF waves into formation 20. When formation 20 has been exposed to a desired number of freeze-thaw cycles, return tubing 30 and supply tubing 40, are removed from well 10, alone with expander means 50 (and the LF wave-generating means, if being used). Well 10 is then ready to be returned to production in accordance with conventional methods.

Figure 2:
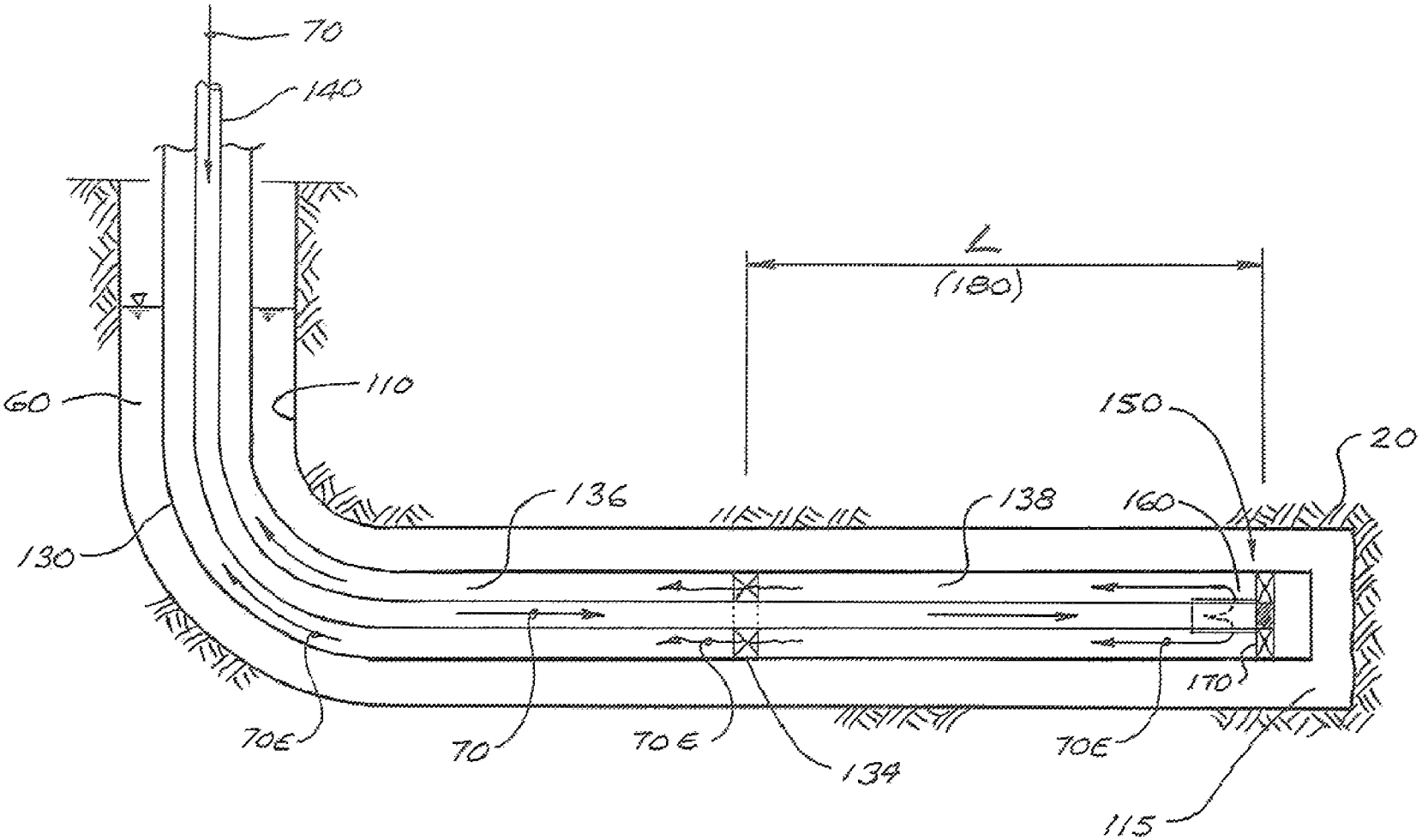
FIG. 2 is a cross-section through a horizontal well extending into a subsurface formation, with refrigeration apparatus in accordance with another embodiment of the invention.
Figure 3:
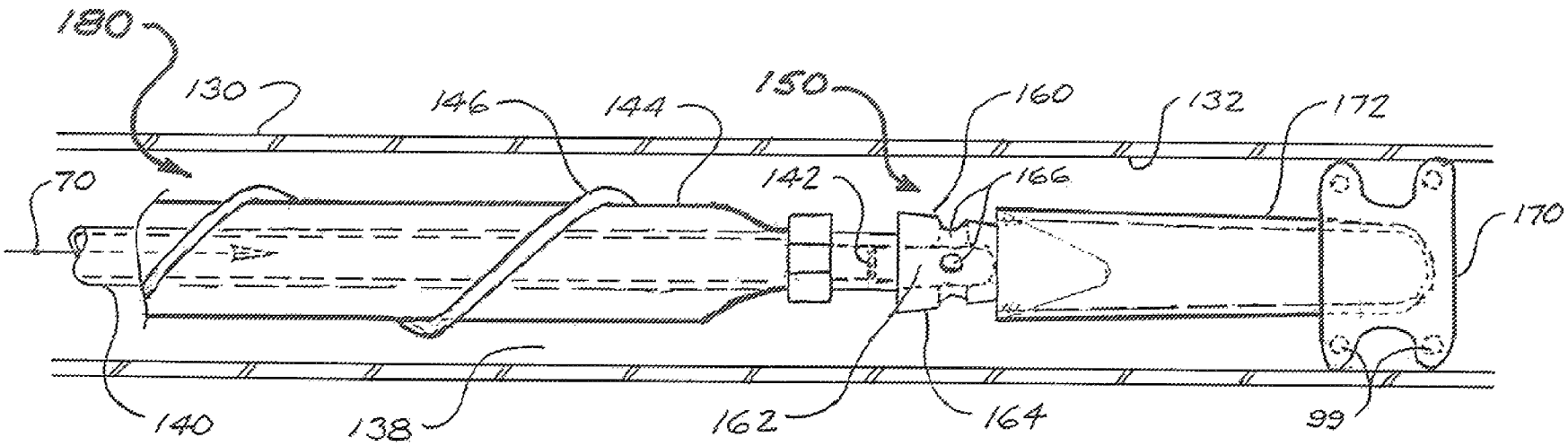
FIG. 3 illustrates one embodiment of a nozzle and movable packer assembly in accordance with the present invention.

The method of the present invention may also be advantageously used in a horizontal wellbore 110, as conceptually illustrated in FIG. 2. It should be noted that FIG. 2 is not to scale; horizontal wellbore 110 will typically be hundreds of feet long. A string of return tubing 130 (e.g., in the form of 2-⅞" diameter coiled tubing, by way of preferred but non-limiting example) is inserted into wellbore 110 as shown, forming a well annulus 116 between return tubing 130 and wellbore 110. A string of refrigerant supply tubing 140 (e.g., 1-¼" diameter, for use in conjunction with 2-⅞" coiled tubing) is inserted within return tubing 130 as shown, with a packer/nozzle assembly 150 connected to the lower end 42 of supply tubing 140. The insertion of supply tubing 140 into return tubing 130 results in the formation of a tubing annulus 136 between supply tubing 140 into return tubing 130. Supply tubing 140 passes through a flow restrictor baffle 134 located at a selected distance from packer/nozzle assembly 150. Flow restrictor baffle 134 has one or more orifices (preferably adjustable) or other suitable means for permitting restricted flow of gaseous or liquid fluids across or through baffle 134. As best seen in FIG. 3, supply tubing 140 terminates in a diffuser nozzle 160 connected to a suitable packer 170 such that the packer/nozzle assembly is scalingly movable within return tubing 130.

A portion of tubing annulus 136 thus forms an annular sub-chamber 138 extending longitudinally between packer 170 and flow restrictor baffle 134 as shown in FIG. 2. The portion of supply tubing 140 that is disposed within annular sub-chamber 138 will be referred to herein as the "stinger" section 180, having a length L corresponding to the distance between packer 170 and flow restrictor baffle 134. On the other side of flow restrictor baffle 134, the remaining portion of tubing annulus 136 extends toward and up the vertical portion of wellbore 110. Flow restrictor baffle 134 may be considered part of stinger 180 and is longitudinally movable, with stinger 180, inside return tubing 130.

Using apparatus generally as described above, the subsurface formation 20 adjacent to horizontal wellbore 110 can be freeze-fractured by the following procedure. First, well annulus 116 is flooded with an aqueous fluid (e.g., fresh water or a brine solution), resulting in permeation of the aqueous fluid into cracks and fissures in the surrounding formation 20. A suitable refrigerant 70 (e.g., liquid carbon dioxide, liquid nitrogen, or liquid propane) is pumped into supply tubing 140, and exits the nozzle in vaporized form into annular sub-chamber 138. As the refrigerant travels toward flow restrictor baffle 134, it absorbs heat from the water in well annulus 116 (and the surrounding formation 20), resulting in expansion and vaporization of refrigerant 70. The vaporized refrigerant 70E passes through flow restrictor baffle 134 (in either liquid or gaseous phase, or in mixed-phase form) into tubing annulus 136, and up to the surface where it will preferably be recovered, recompressed, and re-used (i.e., in a closed-loop refrigeration cycle).

In accordance with well-known refrigeration principles, the foregoing process results in cooling and eventual freezing of formation 20 adjacent to annular sub-chamber 138, producing desired freeze-fracturing effects as previously discussed. The frozen formation can then be thawed, either naturally by the effects of latent geothermal heat, or by circulating a warm fluid (e.g., water, steam, oil, or air) through the refrigerant tubing. As used in this context, the term "warm fluid" denotes a fluid having a temperature greater than zero degrees Celsius; persons skilled in the art will appreciate that the efficacy of the thawing process will be enhanced by using fluids having a temperature considerably higher than zero degrees Celsius. Alternative thawing methods may involve circulation of hydrogen, helium, argon or other gases known to give off heat in response to a reduction in pressure. As well, known induction heating methods may be used during the thaw cycle, alone or possibly in combination with other heating methods. The effectiveness of induction heating may be enhanced by implementing "skin effect" techniques in accordance with known methods.

FIG. 3 illustrates one embodiment of the packer/nozzle assembly 150, located at the end of the stinger section 180. A refrigerant diffuser nozzle 160, which is connected to refrigerant supply tubing 140, has an interior chamber 162 and a nozzle wall 164, plus a number of outlet jets 166 extending through nozzle wall 164. Refrigerant 70 flowing through supply tubing 140 enters interior chamber 162 and exits as expanded or vaporized refrigerant 70E through outlet jets 166 into sub-chamber 138. Nozzle 160 is connected to a flexible packer 170 (either directly or by means of a nozzle receiver 172 or other suitable transition element) such that packer 170 will move longitudinally with stinger 180 when stinger 180 is inserted in or retracted from return tubing 130, while at the same time providing an effective seal against the inner wall 132 of return tubing 130. Packer 170 may be fabricated from rubber or other suitable flexible material. Preferably, an adjustable orifice means 142 is provided in association with nozzle 160 (e.g., incorporated into nozzle 160, or within supply tubing 140 as shown), for varying the rate and velocity of refrigerant injection into sub-chamber 138.

The effectiveness of the refrigeration cycle may be enhanced by encasing stinger 180 within a cylindrical "floating" jacket 144, which has the effect of reducing the cross-sectional area of sub-chamber 138 and in turn increasing the velocity of refrigerant flow within sub-Chamber 138. Refrigeration efficiency may be further enhanced by providing helical fluting 146 around at least a portion of the supply tubing 140 within the stinger section 180 (or around floating jacket 144, as shown in FIG. 3), to promote uniform diffusion of the vaporized refrigerant 70E within sub-chamber 138.

Figure 4A:
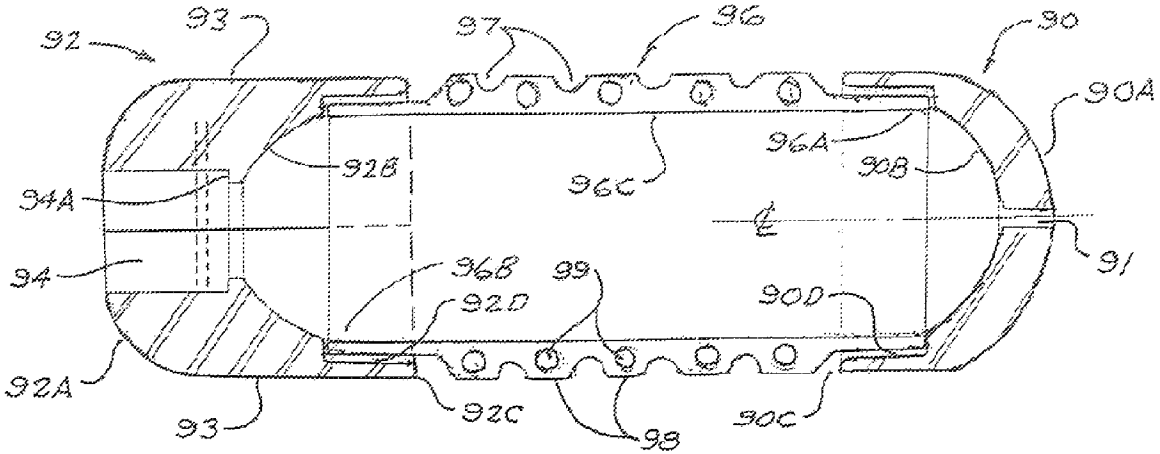
FIG. 4A is a cross-section through the retainer assembly and tubular sleeve of an alternative embodiment of a movable packer in accordance with the invention.
Figure 4B:
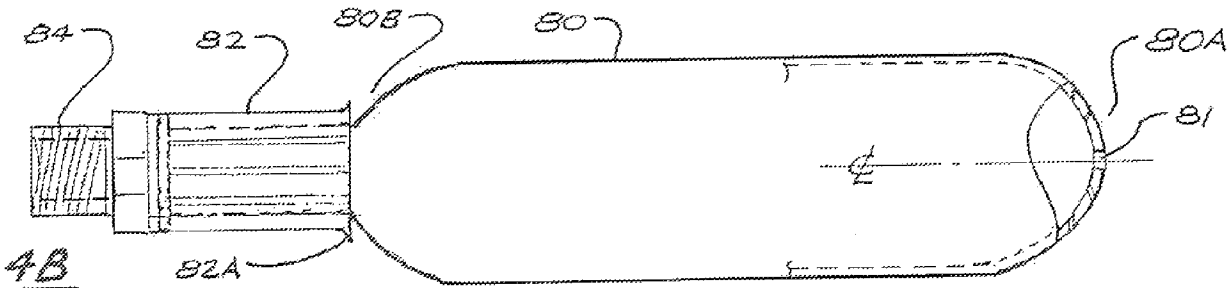
FIG. 4B is a side view of an expandable bladder for use in conjunction with the retainer assembly shown in FIG. 4A.
Figure 4C:
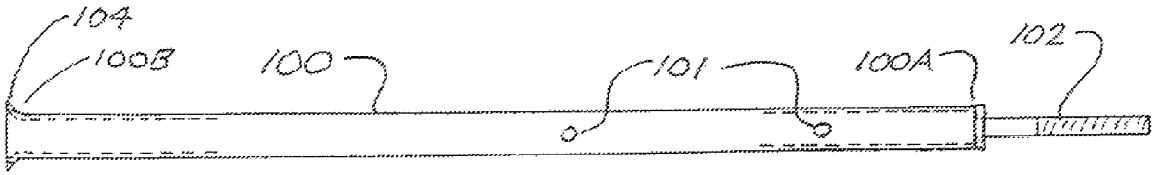
FIG. 4C is a side view of a retainer tube for use in conjunction with the retainer assembly shown in FIG. 4A and the bladder shown in FIG. 4B.

In the particularly preferred embodiment shown in FIGS. 4A, 4B, and 4C, packer 170 comprises:

- an expandable and generally tubular bladder 80 (FIG. 4B);
- a bladder retainer assembly (FIG. 4A) for receiving bladder 80;
- a flexible, expandable tubular sleeve 96 (FIG. 4A); and
- a hollow retainer tube 100 assembly (FIG. 4C).

Bladder 80 has a generally hemispherical first end 80A having a bolt hole 81 on the axial centreline of bladder 80, and an open second end 80B which is securely connected to a tubular connection element 84 by means of a crimped ferrule or other suitable transition element 82 such that the interior of bladder 80 is in fluid communication with the bore of tubular connection clement 84. Transition element 82 is formed with a flared perimeter lip 82A at its end adjacent to bladder 80.

The bladder retainer assembly comprises an end cap 90, a bladder transition housing 92, and an expandable tabular sleeve 96. End cap 90 has a generally hemispherical first end 90A with a concave inner surface 90B generally configured to accommodate first end 80A of bladder 80, and an open second end 90C with an annular interior recess 90D. A bolt hole 91 extends through end cap 90 on the axial centreline of end cap 90. Bladder transition housing 92 comprises a pair of split housings 93 which, when assembled (using suitable bolts, machine screws, or the like), form a generally hemispherical assembly having:

- a first end 92A defining an axial bore 94 with an annular shoulder 94A;
- a concave inner surface 92B generally configured to accommodate a portion of bladder 80 adjacent to transition element 82; and
- an open second end 92C with an annular interior recess 92D.

Tubular sleeve 96 may be made of rubber or any suitable elastic material. Sleeve 96 has a relaxed (i.e., unstressed) diameter approximately equal to or slightly less than the inside diameter of return tubing 130 so that it can be easily moved within return tubing 130 when in its relaxed state, and preferably has an inner diameter approximately equal to or slightly small than the outer diameter of bladder 80. Sleeve 96 has first end 96A and second end 96B configured to be received, respectively, within annular recess 90D of end cap 90 and annular recess 92D of transition housing 92. A central section 96C between ends 96A and 96B is thus exposed such that it will be adjacent to the bore of return tubing 130 when packer 170 is inserted therein.

As illustrated in FIG. 4C, retainer tube 100 has a closed first end 100A and an open second end 100B, and also has one or more spaced refrigerant openings 101 extending through its cylindrical sidewall. A bolt 102 or threaded rod extends coaxially from first end 100A. Second end 100B has a flared circumferential lip 104.

The assembly of this particular embodiment of packer 170 may now be readily understood with reference to FIGS. 4A, 4B, and 4C. First, bladder 80 is positioned with its first end 80A disposed adjacent to concave inner surface 90B of end cap 90. First end 100A of retainer tube 100 is into inserted bladder 80 through open second end 80B thereof, until bolt 102 extends through bolt hole 81 in first end 80A of bladder 80, with flared lip 104 seated within and against tubular connection element 84. End cap 90 is then placed over the bladder/tube subassembly such that bolt 102 extends through bolt hole 91 of end cap 90, and a nut (not shown) is spun onto bolt 102. Tubular sleeve 96 may then be slid over bladder 80 so as to dispose first end 96A of sleeve 96 within annular recess 90D of end cap 90. Transition housing 92 is then assembled by positioning split housings 93 around transition element 82 and second end 80B of bladder 80, with second end 96B of sleeve 96 disposed within annular recess 92D of transition housing 92, with perimeter lip 82A of transition element 82 disposed against annular shoulder 94A, and with second end 80B of bladder 80 disposed adjacent to concave inner surface 92B of transition housing 92, thereby effectively clamping bladder 80 within transition housing 92. With split housings 93 being securely connected to each other, the nut may be tightened on bolt 102 to complete the assembly of packer 170.

To use packer 170, tubular connection element 84 is connected (using suitable adapter means, not shown) to a diffuser nozzle 160 having a forward jet (not shown) extending through nozzle wail 164 at or near the axial centreline of nozzle 160 (in addition to the rearwardly-oriented outlet jets 166). The interior of bladder 80 is thus in fluid communication with interior chamber 162 of nozzle 160 via the forward jet. Packer 170, along with its associated supply tubing 140 is then inserted into return tubing 130. When refrigerant 70 is introduced into supply tubing 140 and flows into interior chamber 162 of nozzle 160, it expands and vaporizes and exits interior chamber 162 through the forward jet as well as through outlet jets 166, such that expanded refrigerant 70E enters retainer tube 100 and exits through refrigerant openings 101 into bladder 80. This causes bladder 80 to inflate and expand radially outward, which results in the exertion of radially outward pressure against inner surface 96D of tubular sleeve 96, thus causing radial expansion of sleeve 96 such that its outer surface is urged into sealing contact with the inner cylindrical wall of return tubing 130, whereupon the method of the invention can be put into operation to freeze-fracture an adjacent zone within the subsurface formation.

To carry out freeze-fracturing operations in a different location within wellbore 110, the flow of refrigerant is stopped, thus relieving pressure within bladder 80 such that tubular sleeve 96 returns to its relaxed state, such that packer 170 can be easily moved to anew location within return tubing 130.

Optionally, sleeve 96 may have annular grooves 97 so as to form annular ribs 98, to enhance the effectiveness of the seal between sleeve 96 and return tubing 130 when sleeve 96 is in a radially expanded state. For the same purpose, hollow annular chambers 99 may be formed within ribs 98.

It is to be noted that the nozzle and packer assemblies shown in FIGS. 3 and 4 are exemplary only. Persons skilled in the field of the invention will understand that nozzle/packer assemblies of various different designs and configurations could be used to beneficial effect with the method of the present invention.

In a particularly preferred embodiment of the method, formation 20 is frozen in intermittent sections along the length of horizontal wellbore 110. Stinger 180 is positioned inside return tubing 130 until it reaches an initial position in the vicinity of the toe 115 of wellbore 110, as schematically depicted in FIG. 2. The refrigeration (or freezing) cycle is then initiated, resulting in formation freezing in a first zone surrounding stinger 180, over a horizontal distance roughly corresponding to stinger length L. Stinger 180 is then partially retracted to a selected second, position within return tubing 130 so as to leave a space between the first frozen zone and stinger 180 in its second position. The freezing cycle is then commenced once again so as to create a second frozen zone, which will be separated from the first frozen zone by a substantially unfrozen zone. Stinger 180 can then be moved to a third position to create a third frozen zone laterally spaced from the second frozen zone, and so on as desired along the length of horizontal wellbore 110.

A particular benefit of this intermittent freezing method is that the presence of an unfrozen zone between freezing zones facilitates the generation of fracturing forces in three directions, not just radial forces. In alternative versions of the method, stinger 180 can be repositioned to freeze formation 20 in the unfrozen areas between the frozen zones; this secondary procedure can be carried out after the initially frozen zones have been thawed, or the thaw cycle can be delayed until formation 20 has been frozen along the full length of the wellbore. Of course, formation 20 can also be frozen in continuous linear stages, without leaving spaces between freezing zones (e.g., by simply retracting stinger 180 a distance approximately equal to L after each freezing stage).

Figure 5:
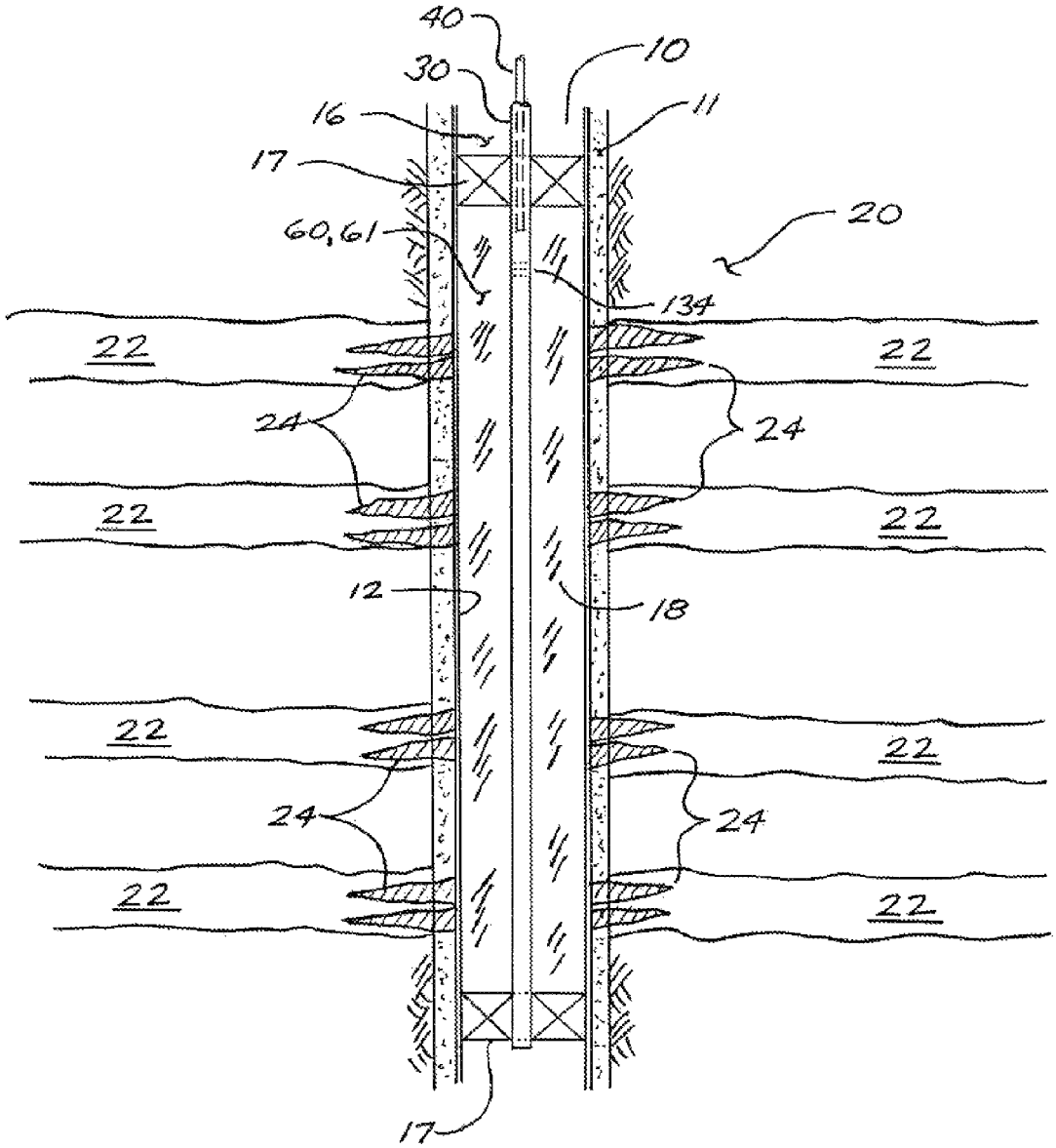
FIG. 5 is a cross-section through a vertical well, illustrating how multiple subsurface zones at different depths can be simultaneously freeze-fractured in accordance with the present invention.

FIG. 5 illustrates how the method of the invention can be used to simultaneously freeze-fracture multiple production zones 22 at different levels within a subsurface formation 20. As shown in FIG. 5, vertical wellbore 10 is cased with a well liner 12, with cement 11 having been injected into the space between liner 12 and the surrounding formation 20. A refrigeration apparatus in accordance with the present invention—comprising a refrigerant supply tubing string 40 disposed within a return tubing string 30, with the lower end of supply tubing string 40 being fitted with a stinger section 170 (not shown in FIG. 5)—is centrally positioned within wellbore 10, creating a well annulus 16 as previously described. Suitable packers 17 (of conventional type or, optionally, ice packers) are disposed within well annulus 16 and around return tubing string 30 at selected elevations so as to block off a sub-chamber 18 within well annulus 16.

Well liner 12 and cement 11 are perforated in the vicinity of production zones 22 in accordance with known methods, thus effectively exposing sub-chamber 18 to production zones 22. Sub-chamber 18 is then flooded with water 60, which seeps into flooded zones 24 of production zones 22 and fills cracks and cavities 24 therein. A flow of refrigerant 70 is introduced into supply tubing 40 in accordance with the method of the invention, freezing water 60 to form ice 61 within sub-chamber 18 while freezing water within flooded zones 24, thus inducing expansion forces to fracture production zones 22. Optionally, well annulus 16 above sub-chamber 18 can also be filled with water to produce an "overbalanced condition" helping to direct the expansion forces from the formation of ice 61 within sub-chamber 18 radially outward from wellbore 10.

It will be readily appreciated by those skilled in the art that various modifications of the present invention may be devised without departing from the essential concept of the invention, and all such modifications are intended to come within the scope of the present invention and the claims appended hereto. It is to be especially understood that the invention is not intended to be limited to illustrated embodiments, and that the substitution of a variant of a claimed element or feature, without any substantial resultant change in the working of the invention, will not constitute a departure from the scope of the invention. By way of non-limiting example, various features and techniques described in association with freeze-fracturing formations surrounding vertical well bores (e.g., as in FIG. 1) may be applied with freeze-fracturing methods associated with horizontal wellbores (e.g., as in FIG. 2), and vice versa.

In this patent document, the word "comprising" is used in its non-limiting sense to mean that items following that word are included, but items not specifically mentioned are not excluded. A reference to an element by the indefinite article "a" does not exclude the possibility that more than one of the element is present, unless the context clearly requires that there be one and only one such element.

What is claimed is:

1. A method for stimulating flow of petroleum fluids from a subsurface formation into a wellbore drilled into and exposed to the formation, said method comprising the steps of:

(a) providing a string of return tubing having an upper end and a lower end;

(b) providing a string of supply tubing having an upper end and a lower end, said lower end being open, and said supply tubing having expander means associated with said lower end;

(c) disposing the return tubing string within the wellbore so as to position the lower end of the return tubing at a selected depth, and so as to form a well annulus between the return tubing and the wellbore;

(d) disposing the supply tubing string within the return tubing string so as to position the expander means at a selected depth, and so as to form a tubing annulus between the supply tubing and the return tubing, with the return tubing string having associated plug means sealing off the tubing annulus at a selected location below the expander means, and further having flow restrictor means disposed within the tubing annulus at a selected distance above said plug means;

(e) ensuring that an aqueous fluid is present in the well annulus to a selected level, and that said aqueous fluid can flow into fissures in adjacent regions of the formation;

(f) initiating a freezing cycle by introducing a flow of liquid refrigerant into the supply tubing, such that the refrigerant passes through the expander means and resultantly vaporizes and flows into the tubing annulus, and continuing the flow of refrigerant to freeze the aqueous fluid in a zone within the well annulus adjacent the portion of the return tubing string between said plug means and said flow restrictor means, and to freeze aqueous fluid within an adjacent first region of the formation; and (g) initiating a thaw cycle by discontinuing the flow of refrigerant and allowing said first region of the formation to thaw; and (h) introducing LF wave energy into the formation in association with the freezing cycle;

wherein the freezing of aqueous fluid within the adjacent first region of the formation creates expansion pressures promoting enlargement of fractures pre-existing in said first region of the formation.

2. The method of claim 1 wherein the LF wave energy is provided in a form selected from the group consisting of electromagnetically-generated waves and mechanically-generated waves.

3. The method of claim 1 wherein the LF wave energy is introduced into the formation by LF wave-generating means associated with the expander means.

4. The method of claim 1 wherein the frequency of the LF waves is between approximately 15 cycles per second and 300 cycles per second.

5. The method of claim 1 wherein the LF wave energy is pulsed.

6. The method of claim 1 wherein the step of ensuring that an aqueous fluid is present within the well annulus to a selected level comprises the additional step of introducing an appropriate volume of aqueous fluid into the well annulus.

7. The method of claim 1 wherein the thaw cycle comprises the additional step, subsequent to discontinuation of the flow of refrigerant, of circulating a warm fluid down the supply tubing and back through the tubing annulus.

8. The method of claim 1 wherein the thaw cycle comprises the additional step, subsequent to discontinuation of the flow of refrigerant, of circulating a gas down the supply tubing and back through the tubing annulus, said gas being a gas known to give off heat in response to a reduction in the pressure of the gas.

9. The method of claim 1 wherein steps (f) and (g) are repeated on a cyclic basis.

10. The method of claim 1 wherein the flow restrictor means is a flow restrictor baffle incorporating means for permitting restricted flow of fluids through the baffle.

11. The method of claim 10 wherein the means for permitting restricted flow of fluids comprises an orifice.

12. The method of claim 11 wherein the orifice is adjustable.

13. The method of claim 1, comprising the further steps of:

(a) repositioning said plug means and said flow restrictor means, along with the portion of the supply tubing string therebetween, to a new position adjacent a second region of the formation;

(b) initiating a freezing cycle by introducing a flow of liquid refrigerant into the supply tubing, such that the refrigerant passes through the expander means and resultantly vaporizes and flows into the tubing annulus, and continuing the flow of refrigerant to freeze aqueous fluid in a zone within the well annulus adjacent the portion of the return tubing string between said plug means and said flow restrictor means, and to freeze aqueous fluid within said second region of the formation; and (c) initiating a thaw cycle by discontinuing the flow of refrigerant and allowing said second region of the formation to thaw;

wherein the freezing of aqueous fluid with the adjacent second region of the formation creates expansion pressures promoting enlargement of fractures pre-existing in said second region of the formation.

14. The method of claim 13 wherein the repositioning step is effected by repositioning the supply tubing string, plug means, and flow restrictor means within and relative to the return tubing string.

15. The method of claim 1 wherein the wellbore within which the portion of the return tubing string between the plug means and the flow restrictor means is disposed, is a substantially horizontal wellbore.

16. A method for stimulating flow of petroleum fluids from a subsurface formation into a wellbore drilled into and exposed to the formation, said method comprising the steps of:

(a) providing a string of return tubing having an upper end and a lower end;

(b) providing a string of supply tubing having an upper end and a lower end, said lower end being open, and said supply tubing having expander means associated with said lower end;

(c) disposing the return tubing string within the wellbore so as to position the lower end of the return tubing at a selected depth, and so as to form a well annulus between the return tubing and the wellbore;

(d) disposing the supply tubing string within the return tubing string so as to position the expander means at a selected depth, and so as to form a tubing annulus between the supply tubing and the return tubing, with the return tubing string having associated plug means sealing off the tubing annulus at a selected location below the expander means, and further having flow restrictor means disposed within the tubing annulus at a selected distance above said plug means;

(e) ensuring that an aqueous fluid is present in the well annulus to a selected level, and that said aqueous fluid can flow into fissures in adjacent regions of the formation;

(f) initiating a freezing cycle by introducing a flow of liquid refrigerant into the supply tubing, such that the refrigerant passes through the expander means and resultantly vaporizes and flows into the tubing annulus, and continuing the flow of refrigerant to freeze the aqueous fluid in a zone within the well annulus adjacent the portion of the return tubing string between said plug means and said flow restrictor means, and to freeze aqueous fluid within an adjacent first region of the formation; and (g) initiating a thaw cycle by discontinuing the flow of refrigerant and allowing said first region of the formation to thaw;

(h) repositioning said plug means and said flow restrictor means, along with the portion of the supply tubing string therebetween, to a new position adjacent a second region of the formation;

(i) initiating a freezing cycle by introducing a flow of liquid refrigerant into the supply tubing, such that the refrigerant passes through the expander means and resultantly vaporizes and flows into the tubing annulus, and continuing the flow of refrigerant to freeze aqueous fluid in a zone within the well annulus adjacent the portion of the return tubing string between said plug means and said flow restrictor means, and to freeze aqueous fluid within said second region of the formation; and (j) initiating a thaw cycle by discontinuing the flow of refrigerant and initiating a thaw cycle by discontinuing the flow of refrigerant and allowing said second region of the formation to thaw;

wherein:

(k) the freezing of aqueous fluid within the adjacent first region of the formation creates expansion pressures promoting enlargement of fractures pre-existing in said first and second regions of the formation; and (l) the repositioning step is effected by repositioning the supply tubing string, plug means, and flow restrictor means within and relative to the return tubing string.

* * * * *